US010077560B2

(12) United States Patent
Medbø et al.

(10) Patent No.: US 10,077,560 B2
(45) Date of Patent: Sep. 18, 2018

(54) STAIR ASSISTANCE DEVICE

(71) Applicant: ASSITECH AS, Trondheim (NO)

(72) Inventors: Eirik Gjelsvik Medbø, Trondheim (NO); Halvor Wold, Trondheim (NO); Ingrid Lonar, Trondheim (NO); Steinar Gamst, Trondheim (NO)

(73) Assignee: ASSITECH AS, Trondheim (NO)

( * ) Notice: Subject to any disclaimer, the term of this patent is extended or adjusted under 35 U.S.C. 154(b) by 423 days.

(21) Appl. No.: 14/892,582

(22) PCT Filed: May 29, 2014

(86) PCT No.: PCT/EP2014/061209
§ 371 (c)(1),
(2) Date: Nov. 20, 2015

(87) PCT Pub. No.: WO2014/195227
PCT Pub. Date: Dec. 11, 2014

(65) Prior Publication Data

US 2016/0090743 A1 Mar. 31, 2016

(30) Foreign Application Priority Data

Jun. 5, 2013 (GB) ..... 1309982.5
Apr. 10, 2014 (GB) ..... 1406451.3

(51) Int. Cl.
*B66B 9/08* (2006.01)
*E04F 11/18* (2006.01)

(52) U.S. Cl.
CPC ..... *E04F 11/1863* (2013.01)

(58) Field of Classification Search
CPC ..... E04F 11/1863; B66B 9/0846; B66B 9/08; B66B 23/22; A61H 2003/001; A61H 3/00; A61G 7/1034
See application file for complete search history.

(56) References Cited

U.S. PATENT DOCUMENTS 4,913,264 A * 4/1990 Voves ..... B66B 9/08 187/201
5,269,227 A * 12/1993 Warren ..... E04F 11/1863 105/29.1

(Continued)

FOREIGN PATENT DOCUMENTS

AU 88187 91 A 6/1992
CA 2151984 A1 12/1996

(Continued)

OTHER PUBLICATIONS

Stairaid Ltd, "StairAID: How does it work?" Retrieved from internet: URL:http://www.stairaid.clientfile.net/information.php?s=How-does-it-work?&section=7, Retrieved on Nov. 29, 2013, 1 Page.

*Primary Examiner* — Gisele D Ford
(74) *Attorney, Agent, or Firm* — Eversheds Sutherland (US) LLP

(57) ABSTRACT

A stair assistance device for assisting a person to climb up and down stairs. The device may include a handle, a saddle for engagement with a guide rail mounted alongside the stairs, the saddle being connected to the handle and being arranged for sliding motion along the guide rail, a braking rail for mounting alongside the stairs parallel to the guide rail, and a bracket connected to the saddle, the bracket being for selectively engaging with the braking rail to prevent motion of the handle and saddle along the guide rail. The bracket and the braking rail together form a releasable ratchet that, when engaged, prevents movement of the handle in a downstairs direction and allows movement of the handle in an upstairs direction. The handle may be coupled to the pawl of the ratchet such that a predetermined movement of the handle will disengage the pawl from the ratchet.

14 Claims, 8 Drawing Sheets

(56) References Cited

U.S. PATENT DOCUMENTS

| | | | | |
|---|---|---|---|---|
| 2004/0104078 | A1* | 6/2004 | Szentistvany | B66B 9/0815 187/201 |
| 2005/0224293 | A1* | 10/2005 | Molnar | B66B 9/0807 187/200 |
| 2005/0224294 | A1* | 10/2005 | Vroegindeweij | B66B 9/0846 187/201 |
| 2006/0117984 | A1* | 6/2006 | Carlsen | B66B 9/0846 105/29.1 |
| 2006/0243112 | A1* | 11/2006 | Debrunner | B66B 9/0846 83/455 |
| 2007/0278043 | A1* | 12/2007 | Durant | B66B 9/08 187/201 |
| 2008/0264722 | A1* | 10/2008 | Yang | E04F 11/1863 182/15 |
| 2011/0278096 | A1* | 11/2011 | Kentenich | B66B 1/34 187/201 |
| 2014/0150354 | A1* | 6/2014 | Danziger | E04F 11/1863 52/29 |
| 2014/0231738 | A1* | 8/2014 | Amos | E04F 11/1863 256/59 |
| 2014/0374681 | A1* | 12/2014 | Brindamour | E04F 11/1863 256/65.16 |

FOREIGN PATENT DOCUMENTS

| | | | |
|---|---|---|---|
| CA | 2 416 225 | A1 | 7/2004 |
| DE | 20 2010 002 312 | U1 | 7/2010 |
| GB | 1 487 558 | A | 10/1997 |
| GB | 2 335 933 | A | 10/1999 |
| GB | 2436555 | B | 10/2007 |
| GB | 2 440 387 | A | 1/2008 |
| JP | 3885141 | B1 | 2/2007 |
| JP | 2007 146621 | A | 6/2007 |

* cited by examiner

STAIR ASSISTANCE DEVICE

The current invention relates to a stair assistance device for assisting people to climb up and down stairs.

Stairs are a common feature of modern life. They are often the primary mechanism for moving between floors in buildings and in addition are widely used in outdoor spaces. It can often be the case the people find it difficult to walk up and down stairs. Mobility problems may arise as a consequence of illness, injury or disability, for example. Whilst one solution to this problem is to provide an alternative to stairs, such as a ramp, an elevator or a stair-lift, this is not possible in all situations and can be expensive. Furthermore, the action of walking up and down stairs provides valuable exercise and can be important as a means of maintaining fitness and as a part of rehabilitation when recovering from an illness or injury.

It is therefore desirable to provide a way to assist those with mobility problems to ascend and descend stairs. An assistance device should ideally be inexpensive and be capable of installation at a stairway without significant modification being required. A number of solutions have been proposed, including some using a powered device and others using an unpowered mechanical device. GB 2436555 describes a number of the known types of devices. Of these types an unpowered mechanical device is considered to be better for the present purposes since it is cheaper and easier to install. An unpowered device can also easily be used outdoors and/or in areas where electrical connection is not readily available.

GB 2440387 discloses an example of a simple mechanical device that uses a saddle slidably attached to a guide rail. The guide rail follows the path of the stairs and would be fitted in a similar location to a conventional stair rail. A support arm extends over the stairs perpendicular to the saddle and guide rail and can be held by the user's hands when they use the stairs. The saddle is lined with a region of low friction material and a region of high friction material and it is designed so that when it is pushed in a direction down the stairs then the high friction material grips the rail and movement is prevented, whereas when it is pushed in a direction that is up the stairs then the low friction material is in contact with the guide rail and it can slide freely.

Another known stair assistance device is sold by Crichton Manufacturing Group of the United Kingdom under the trade name StairAID. Details of this device can be viewed at www.stairaid.com. The device makes use of a stair rail of conventional design in combination with a special braking rail that is parallel with the stair rail, with a sliding handgrip assembly mounted to the rails. The handgrip is hooked onto the stair rail and can rotate to a limited degree around the longitudinal axis of the stair rail. The braking rail is vertically offset from the stair rail and includes a toothed strip running in parallel with the stair rail. The handgrip connects to the braking rail at the toothed strip so that the downward force from the weight of the handgrip will cause a protrusion on the handgrip assembly to engage with the toothed strip. In this configuration the handgrip cannot move up and down the stairs and hence provides a fixed handhold for the user. If it is desired to walk up or down the stairs then lifting the weight of the handgrip assembly will disengage the handgrip from the toothed strip and allow it to slide freely along the stair rail. The handgrip gives stability and confidence to the user and should the user be unsteady then a downward force on the handgrip will cause the handgrip to engage with the toothed strip to provide a secure and fixed handhold.

However, these known devices are not without limitations. The device of GB 2440387 requires a force along the upward direction of the stairs in order for it to slide easily, and therefore it is not possible for it to be used easily when a person with impaired mobility is descending the stairway. Moreover, the use of a solely sliding contact with friction materials means that there is a high rate of wear. The StairAID device addresses some of these limitations but requires a lifting movement at all times, which can be difficult for the user. It would clearly be desirable to obtain a stair assistance device with all of the advantages of the above described devices whilst avoiding the disadvantages.

Viewed from a first aspect, the invention provides a stair assistance device for assisting a person to climb up and down stairs, the device comprising: a handle; a saddle for engagement with a guide rail mounted alongside the stairs, the saddle being connected to the handle and being arranged for sliding motion along the guide rail; a braking rail for mounting alongside the stairs parallel to the guide rail; and a bracket connected to the saddle, the bracket being for selectively engaging with the braking rail to prevent motion of the handle and saddle along the guide rail; wherein the bracket and the braking rail together form a releasable ratchet that, when engaged, prevents movement of the handle in a downstairs direction and allows movement of the handle in an upstairs direction; and wherein the handle is coupled to the pawl of the ratchet such that a predetermined movement of the handle relative to the braking rail will disengage the pawl from the ratchet so that the handle may move freely in both the upstairs and the downstairs direction.

This device has the advantage that movement of the handle in an upstairs direction is permitted at all times. No special movement or lifting of the handle is required when ascending the stairs. As a result it is possible for people with more severely impaired mobility to use the device to go up the stairs, which extends the utility of the device for exercise and rehabilitation. Note that in this case the movement of the handle in an upstairs direction (when the stair assistance device is in use and installed in a stairway) is a direction upward and generally parallel with the slope of the stairs and movement of the handle in a downstairs direction is an opposite movement. The handle would typically be arranged to, in use, extend from the guide rail in a direction perpendicular to the guide rail and over the stairs.

The predetermined movement of the handle relative to the braking rail may be any suitable movement. The only essential feature is that the movement disengages the pawl from the ratchet mechanism. For example, there may be a linkage between the handle and the pawl that acts to rotate the pawl away from its engaged position. In a preferred embodiment the predetermined movement is a simple lifting of the handle to rotate the handle about the long axis of the guide rail and move the bracket and pawl sideways away from the braking rail to thereby disengage the pawl. This motion uses minimal moving parts and it is simple for the user. Thus, when going upstairs the handle may be in any position, which allows upstairs use by people with a wide range of movement capabilities. When going downstairs the device can move freely when lifted, but the pawl will engage in the ratchet mechanism to prevent downstairs movement of the handle when the handle is not sufficiently lifted. Hence, this arrangement maintains the advantages of the StairAID device but also permits upward movement for a less able user.

There are a variety of ways for the ratchet mechanism to be implemented. Thus, the pawl is typically a rotating finger and it is arranged to engage with a rack, which is preferably a linear rack extending along the length of the braking rail. The pawl is biased toward the rack, which may be done by gravity but preferably is done by a resilient biasing device such as a spring.

The rack preferably has teeth that are angled in the direction down the stairs, which provides a more secure engagement of the pawl and rack to stop the handle from moving in the downstairs direction. With this arrangement the faces of the teeth that engage with the pawl connect to the top land or peak of the tooth at a point that in the upstairs direction compared to the point where the faces connect to the bottom land or trough of the tooth.

The teeth of the rack may take any suitable form and be at any desired pitch. A smaller pitch will ensure that the handle is stopped more quickly if the user is unsteady and the handle begins to slide in the downstairs direction. However it can be more complicated to manufacture and thinner teeth will have lesser strength. One preferred arrangement is to form the teeth as lands between holes formed along the length of the material of the braking rail. Thus, the braking rail may comprise a strip of generally rigid material with holes spaced along the strip.

When the predetermined movement to disengage the pawl is a lifting of the handle then the braking rail may be arranged to restrict movement of the bracket away from the braking rail. For example, the braking rail may be a channel that encloses an element of the bracket and stops further movement once there has been sufficient movement to disengage the pawl from the rack. One possible embodiment is a C-channel (open sided box channel) that encloses the bracket wherein the ends of the C engage with shoulders on the bracket and prevent it from moving further. In this arrangement the opening of the C-channel may face outward from the support surface that holds the braking rail and the rack of the ratchet may be at a base of the C-channel, or at the upright side of the C-channel facing the opening. The support surface might typically be a wall of the stairway.

It is, however, preferred to have an adjustable mechanism for restraining movement of the bracket. In particular it is preferred to have a locking device for selectively preventing disengagement of the ratchet. Thus, a preferred embodiment comprises a locking device with a first position where the ratchet can be disengaged by the predetermined movement of the handle and a second position where the ratchet cannot be disengaged. Preferably the locking device restricts movement of the handle when it is in the second position. It is also preferred for the locking device to be able to be disengaged completely, for example during assembly or disassembly of the device.

This feature, in combination with the use of a ratchet mechanism, provides considerable further advantages. It means that when the device is used to assist a person going upstairs then the device can be locked with the pawl of the ratchet engaged. With the locking device in the second position a downstairs movement of the handle will always be prevented no matter what forces are applied to the handle. This enhances the safety of the device. In the prior art StairAID device a vertically downward force on the handgrip (or an absence of lifting force) is required in order for the handgrip to engage with the toothed strip.

If the user was applying any lifting force to the handgrip then the toothed strip would not be engaged and it would be possible for the user to fall down the stairs, resulting in a potentially very serious accident. This is a particular risk when going up the stairs, since the user may fall backwards lifting their hands, disengaging the handgrip when it is needed most. With the use of a ratchet mechanism and locking device the safety of the device in that situation is maintained.

The locking device may comprise an adjustable flap connected to the bracket, wherein in a first position the flap allows a sufficient range of movement of the bracket relative to the braking rail in order to permit the pawl to disengage from the rack, and in a second position the movement of the bracket is restricted so that the pawl always remains engaged. The adjustable flap may, for example, move in a sliding fashion relative to the bracket in order to increase and decrease a distance by which the bracket can move. In a preferred embodiment a secondary locking mechanism acts to secure the flap in its second position. In one example the flap slides in a direction that is toward and away from the wall of the stairway, when the stair assistance device is in use and installed in a stairway. Thus, the flap may act as a stop that governs the maximum distance that the bracket can move away from the wall. In another example the flap slides in a direction that is generally vertical, when the stair assistance device is in use and installed in a stairway. In this case the flap may be disengaged from the rail in the first position, hence not restricting movement of the bracket, and the flap may be engaged with the rail in the second position, preventing movement of the bracket to disengage the pawl. There may also be a secondary stopping member on the bracket that acts to restrict movement of the bracket beyond a maximum point when the flap is in the first position.

The handle may include gripping portions at an upper and a lower position for ease of use both going upstairs and downstairs. Preferably the gripping portions extend perpendicular to the guide rail and extend over the stairs, when the handle is in use. In one preferred embodiment the handle has top and bottom bars as the gripping portions.

The guide rail is preferably similar in form to a conventional stair rail and in some cases a pre-existing stair rail may be used as the guide rail. This is makes installation of the assistance device easier, and simply requires the pre-existing stair rail to be compatible with the saddle. Alternatively a dedicated guide rail may be provided, for example a rail that is made of a hardwearing material to allow for sliding contact with the saddle. Whether or not a pre-existing stair rail is used the guide rail advantageously provides the same function as a stair rail, which means that able bodied users can use the stairway as normal. The stair assist device may include a guide rail and/or a braking rail as component parts of the device. In this case the device may also include one or more wall brackets, preferably brackets for holding both of the guide rail and the braking rail on a wall. Using a wall bracket in this way ensures that the spacing between the guide rail and braking rail is controlled. The guide rail and/or braking rail may be provided in segments that are coupled together at each bracket. This makes it easy to combine straight and curved rail segments to fit the shape of a stairway.

The saddle may slide along the guide rail in frictional contact therewith, but preferably the saddle includes rotating bearing means for rolling contact with the guide rail, for example wheels or rollers. This reduces wear and provides an easier sliding motion.

The guide rail may be included as a part of the claimed assistance device or included in a kit supplied to the user for installation along with the assistance device.

It will be appreciated that in some circumstances the presence of the assistance device could hinder normal use of the stairway. For example there may not be space for the handle to be stowed out of the way of the stairs at the top or bottom of the stairway. This will particularly be the case when the assistance device is used in the home, where there may be limited space on and around the stairway. Therefore, the device may include a folding mechanism that enables the handle to be folded away. This can advantageously avoid restriction of normal use of the stairway.

A folding mechanism is made more complicated when the handle includes top and bottom gripping portions, since the handle will then extend in a vertical direction as well as in a direction perpendicular to the guide rail. In this situation there is a plane of the handle that extends in the vertical direction in normal use and it is desirable to rotate the handle so that this plane is parallel to a wall of the stairway.

An example folding mechanism may involve a hinged connection of the handle to the bracket and/or saddle, with a spring lock that prevents rotation of the handle until it is disengaged. The spring lock may, for example, be disengaged by pushing an actuation button. It is preferred for the spring lock to automatically re-engage when the handle is returned to the position for normal use.

In another example the folding mechanism is arranged to permit rotation of the handle about an axis that is at about 45 degrees to the vertical and extends away from the guide rail across the plane of the handle. This enables a handle including top and bottom gripping portions to be folded away flat against a wall, since the handle can be rotated up toward the wall and also rotated around the plane of the handle so that the handle faces the wall.

The folding mechanism feature of the stair assistance device is considered to be novel and inventive in its own right and therefore, viewed from a second aspect, the invention provides a stair assistance device for assisting a person to climb up and down stairs, the device comprising: a handle including top and bottom gripping portions, such that there is a plane of the handle that extends in the vertical direction in normal use; a saddle for engagement with a guide rail mounted alongside the stairs, the saddle being connected to the handle and being arranged to allow sliding motion along the guide rail; a braking rail for mounting alongside the stairs parallel to the guide rail; a bracket connected to the saddle, the bracket being for selectively engaging with the braking rail to prevent motion of the handle and saddle along the guide rail; and a folding mechanism that enables the handle to be folded away, wherein the folding mechanism is arranged to permit rotation of the handle either about an axis that is at about 45 degrees to the vertical and extends away from the guide rail across the plane of the handle, or about an axis that is, in use, generally perpendicular to the guide rail.

The device of the second aspect may also include the features of the first aspect and/or any of the preferred features discussed above.

The axis may be at 45 degrees to the vertical or perpendicular to the guide rail. When the folding mechanism permits rotation of the handle about an axis that is perpendicular or generally perpendicular to the guide rail then this folding mechanism may comprise a hinge that couples the handle to the bracket and/or saddle. Preferably a spring lock is used to releasably latch the handle in the unfolded position. The spring lock may be arranged to automatically engage when the handle is moved from the folded to the unfolded position.

The folding mechanism may be arranged to allow rotation only about the axis at about 45 degrees to vertical. This may be implemented via a single rotating joint that couples the handle to the saddle, wherein the rotating joint is mounted to the saddle to provide a rotation about the axis. Alternatively the folding mechanism may be arranged to permit rotation about more than one axis, wherein the rotations about the multiple axes combine to create a total rotation that is about the axis at about 45 degrees to the vertical. Preferably there are two axes of rotation. For example, it will be appreciated that 90 degrees of rotation about each of two orthogonal axes is equivalent to 90 degrees of rotation about a single intermediate axis. One example of the folding mechanism comprises pivots connected to one another to produce the required combined motion, such as two cylindrical joints with orthogonal axes of rotation. Another example of a suitable folding mechanism with multiple axes of rotation is a ball joint.

A preferred embodiment of the folding mechanism is a ball joint with a restricted degree of freedom, wherein the socket has an opening that constrains the rod connected to the ball. The opening may permit the rod to rotate about its longitudinal axis and to rotate perpendicular to its longitudinal axis along a 90 degree arc. More preferably the opening permits the rod to rotate perpendicular to its longitudinal axis along a 90 degree arc and to rotate about its longitudinal axis only at a first end of this arc, with rotation about its longitudinal axis being prevented at the second end of the arc. This can be achieved by the use of a rod of stadium shaped cross-section, and an opening that narrows to the width of the stadium at the second end, but permits rotation of the stadium at the first end so that the handle can be placed flat against the stairway wall. With this arrangement when the rod of the bearing is at the second end of the arc then the handle is in the position for normal use. It is therefore advantageous to prevent rotation using the bearing, since this means that the correct use of the handle is facilitated without the need for a further mechanism to restrict the rotational movement when the handle is in the walking position. When the rod of the bearing is at the first end of the arc then it is necessary for rotation about its longitudinal axis to be permitted so that the handle can be folded flat to the wall.

Preferably the width of the opening transitions gradually from the first end to the second end, optionally with a zone of fixed narrow width at the second end. The zone of fixed narrow width may for example cover 5 to 20 degrees of rotation along the 90 degree arc. This shape of opening in the socket means that only a lifting motion of the handle is possible whilst the rod is at the second end, whereas once the rod moves out of the zone of fixed width then rotation about the longitudinal axis of the rod becomes possible, with the permitted degree of rotation increasing as the rod moves toward the first end of the arc until full rotation is possible so that the handle can be flat against the wall in the fully folded position. In an alternative to this arrangement the opening may be a cam that guides the stadium around a 90 degree rotation of the longitudinal axis of the rod as the rod passes along the 90 degree arc.

It is preferred for the bracket of the device to be connected directly to the saddle, rather than being connected to the saddle via the handle. This means that when a folding mechanism is present then the handle can be folded away without any interference from the bracket, which will not move. Thus, the bracket and the saddle may form one piece, with this piece being connected via the folding mechanism to the handle.

It will be appreciated that the device described above does not require any outside source of power and hence advantageously it is an unpowered mechanical device. As noted above this means that it can be installed in any location, even when electrical power is not available. This includes outdoor locations, for example in areas where people with mobility problems may wish to use the stairs and where a ramp or other stair replacement is not available or not possible. Such locations might include hospitals and nursing homes.

Certain preferred embodiments of the invention will now be described by way of example only and with reference to the accompanying drawings, in which.

Figure 1:
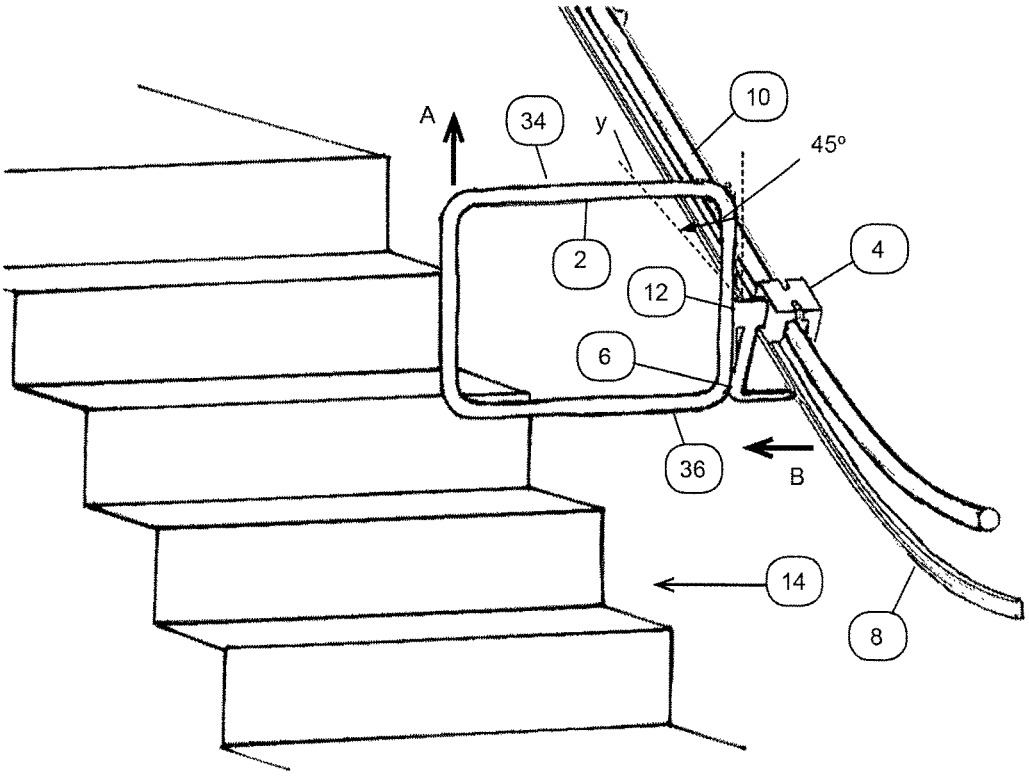
FIG. 1 shows a stair assistance device.

The stair assistance device of FIG. 1 has four main parts, comprising a handle 2, saddle 4, bracket 6 and braking rail 8. The stair assistance device is connected onto a guide rail 10, which is similar in design to a conventional stair rail. The guide rail 10 can be supplied for installation with the stair assistance device or it an existing stair rail may be used. The bracket 6 is attached to the saddle 4 in a rigid fashion. The handle 2 is also attached to the saddle 4. The stair assistance device also includes a folding mechanism 12, which is located between the saddle 4 and the handle 2, and which is discussed in more detail below. The guide rail 10 and braking rail 8 are generally parallel and extend along a stairway following the stairs 14. They are mounted to a wall of the stairway.

Figure 2:
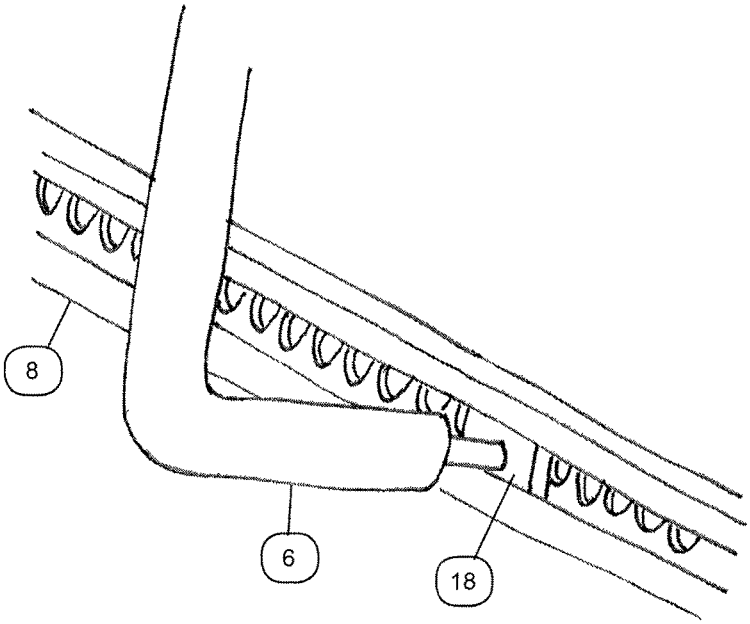
FIG. 2 is a close up view of the bracket and braking rail of the device of FIG. 1.

The saddle 4 is fitted to the guide rail 10 using rollers or wheels and hence can slide up or down the guide rail 10. The bracket 6 can selectively engage the braking rail 8 in order to prevent movement of the handle 2 up or down the stairs by preventing sliding of the saddle 4 along the guide rail 10. FIG. 2 shows a close up of the connection of the bracket 6 to the braking rail 8. The braking rail 8 includes a sequence of holes 16 that form a rack for a ratchet, with the material between the holes acting as the teeth of the rack. The bracket 6 and braking rail 8 together form a ratchet as described below with reference to FIGS. 3 to 5. The braking rail 8 in this embodiment is a C-channel that holds the end piece 18 of the bracket 6 in place. A degree of movement away from the braking rail 8 is permitted by play within the C-channel.

Figure 3:
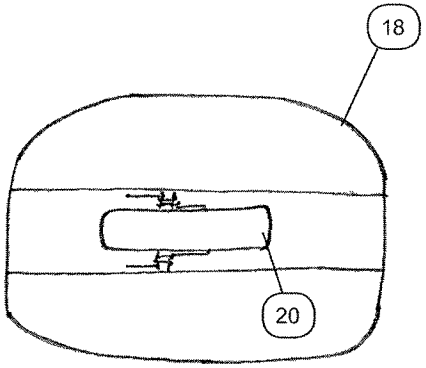
FIGS. 3 and 4 show two views of the bracket, which includes a pawl.
Figure 4:
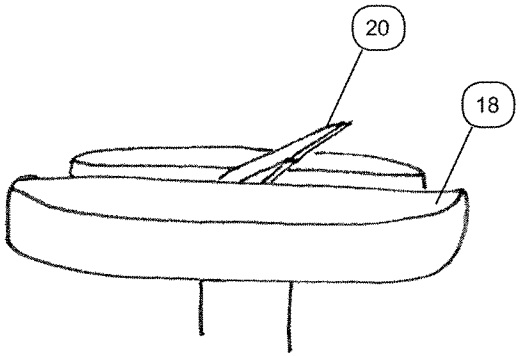
Figure 5:
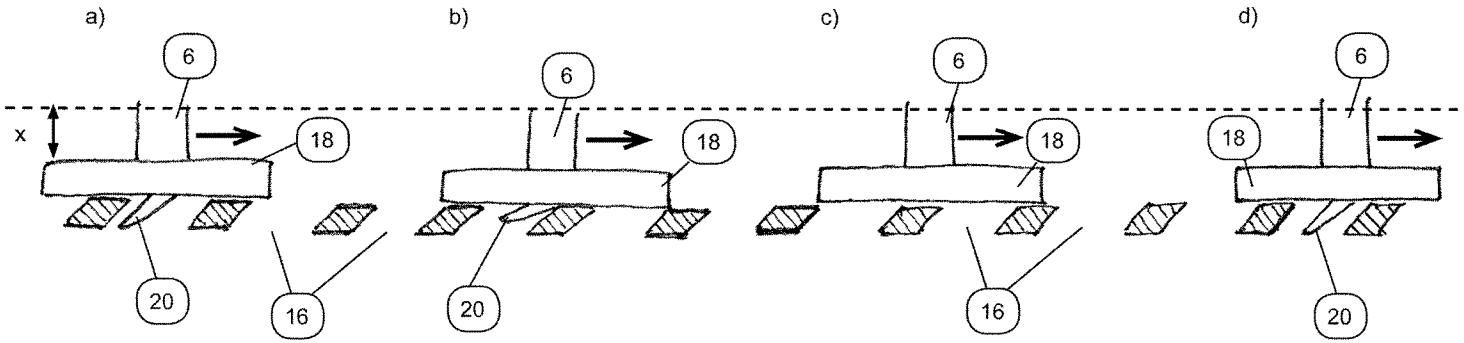
FIG. 5 is a sequence of diagrams showing how the bracket and pawl mechanism traverses the braking rail.

FIGS. 3 and 4 show details of the end piece 18 of the bracket 6 that are not visible in FIGS. 1 and 2. A pawl 20 is mounted within the end piece 18 and protrudes out of the end piece 8 toward the holes 16 of the braking rail 8. The pawl 20 is biased by a spring in the direction indicated by the arrow in FIG. 4. The pawl 20 is also angled in the downward direction of the braking rail, which would be to the right in the orientation shown in FIGS. 3 and 4. As is shown in FIG. 5 the teeth formed by the holes 16 are also angled in the downward direction of the braking rail 8, which is to the left in FIG. 5. The sequence of diagrams in FIG. 5 shows the end piece 18 of the bracket 6 moving in an upward direction (to the right, as indicated by the arrows) with the pawl 20 being moved against the force of the spring by the teeth and not restricting motion of the bracket 6 along the braking rail 8.

In FIG. 5 *a*) the pawl 20 is in a hole 16 between teeth and would of course prevent downstairs (leftward) movement of the bracket 6. If the bracket 6 moves in an upstairs direction (to the right) then the pawl 20 is rotated into the end piece 18 and over the next tooth as shown in FIGS. 5 *b*) and *c*). The spring then pushes the pawl 20 into the next hole 16 as shown in FIG. 5 *d*). Thus, during an upstairs motion the saddle 4 and handle 2 move freely up the guide rail 10 and the user can walk up the stairs using the handle 2 for additional balance and stability. If the user becomes unbalanced or falls then any downstairs motion of the handles is prevented since the pawl 20 will be retained in one of the holes 16.

In order to permit a downstairs movement of the stair assistance device the handle 2 should be lifted as shown by the arrow A in FIG. 1. This will rotate the handle 2 about the guide rail 10 and pull the bracket 6 away from the braking rail 8 as shown by the arrow B in FIG. 1. As noted above the braking rail 8 allows for some movement of the bracket 6. Once the end piece 18 has moved away from the teeth by a distance X (shown in FIG. 5) then the pawl 20 will no longer be able to engage with the holes 16 and a downstairs sliding of the handle 2 and saddle 4 will be permitted. The dashed line 22 in FIG. 5 represents the edge of the C-channel of the braking rail 8, which will keep the bracket 6 from moving too far. Thus, with the handle 2 lifted the user can descend the stairs using the device for assistance, or an able bodied user can return the assistance device to the base of the stairs. Should the handle 2 be dropped, for example if the user becomes unsteady or falls, then the pawl 20 will reengage with the holes 16 and downstairs movement will be prevented.

Figure 6:
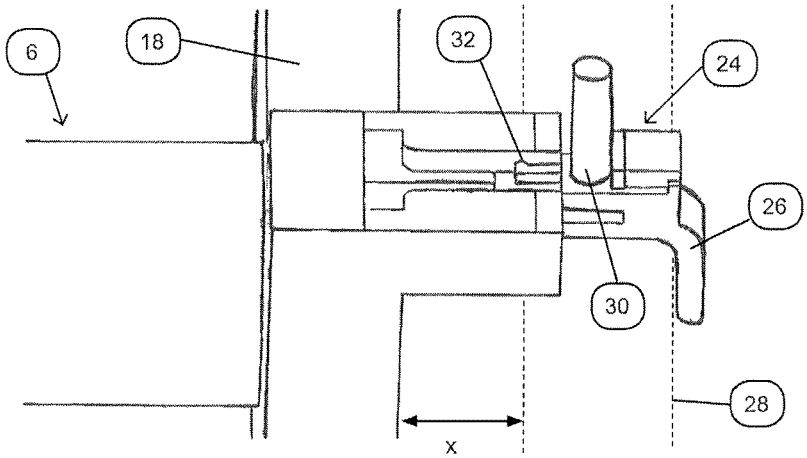
FIG. 6 shows a locking device for the bracket, where the locking device is in a first position, which permits disengagement of the pawl.
Figure 7:
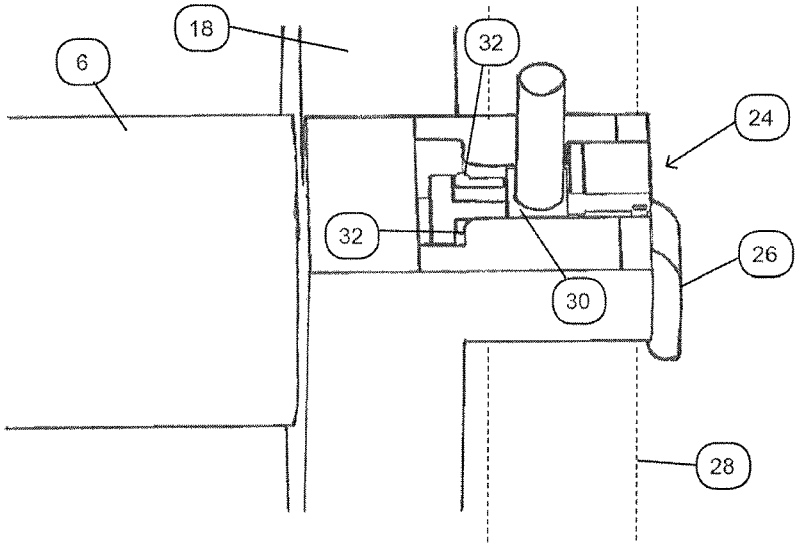
FIG. 7 shows a similar view with the locking device in a second position where the pawl would be permanently engaged.
Figure 8:
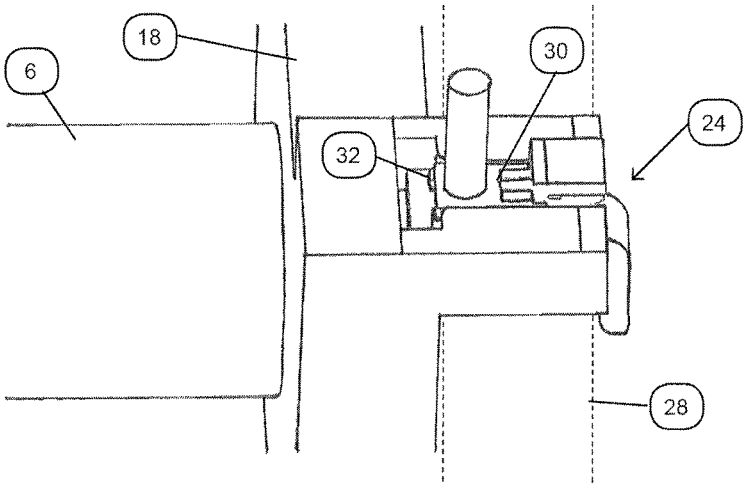
FIG. 8 shows the locking device in the second position with a secondary locking mechanism engaged.

The preferred embodiment is equipped with a locking device 24 as illustrated in FIGS. 6 to 8. The locking device 24 is mounted to the end piece 18 of the bracket 6 and interacts with elements of the braking rail 8. The locking device 24 comprises a flap 26 that acts to limit movement of the end piece 18 within or relative to the braking rail 8. In FIGS. 6 to 8 the dashed lines 28 represent an element of the braking rail 8 that includes the holes 16 and the braking rail 8 would extend parallel with the dashed lines 28.

FIG. 6 shows the locking device 24 in a first position, which permits disengagement of the pawl 20. The flap 26 is spaced apart from the end piece 18 and allows for the movement X to pull the pawl 20 away from the holes 16. In FIG. 7 the locking device 24 is in a second position where flap 26 has been slid closer to the end piece 18 such that the pawl 20 would be permanently engaged with the holes 16.

The locking device 24 also includes a secondary locking mechanism consisting of a bolt 30 and a pair of locking arms 32. When the flap 26 is slide into the second position, as shown in FIG. 7, lugs at the ends of the locking arms 32 resiliently engage with shoulders connected to the end piece 18. The bolt 30, which extends between the locking arms 32, can then be slide along the length of the locking arms 32 as shown in FIG. 8. This engages the secondary locking mechanism by securing the locking arms 32 in their spaced apart configuration, which means that it is not possible to move the lugs out of engagement with the shoulders. This locks the flap 24 in the second position. This locked configuration is a very safe configuration for use of the stair assistance device for walking upstairs, since the pawl 20 must always be in engagement with the holes 16.

As mentioned above with reference to FIG. 1 the stair assistance device includes a folding mechanism 12. The folding mechanism 12 allows the handle 2 to be folded up and round so that it can be stowed against a wall. This means that the stair assistance device will not obstruct normal use of the stairs 14. With further reference to FIG. 1, it will be seen that the handle 2 includes a top bar 34 and bottom bar 36, which are spaced apart vertically. The two bars 34, 36 sit in a plane defined by the handle 2 and this plane should be placed flat against the wall. Several possible arrangements for the folding mechanism have been devised, each of which has the same end result, with the handle 2 being rotated a quarter turn about an axis Y that is at 45 degrees to the vertical and extends away from the guide rail 10 across the plane of the handle 2. This axis Y is indicated by a dashed line in FIG. 1.

Figure 9:
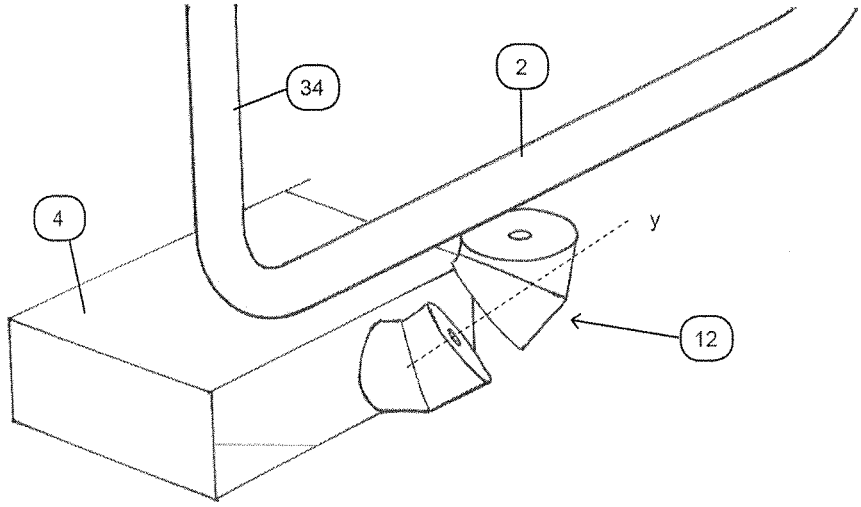
FIG. 9 illustrates an example of a folding mechanism for the handle of the stair assistance device.

A first example of a folding mechanism 12 is shown in FIG. 9 in an exploded diagram. This folding mechanism 12 simply consists of a cylindrical joint aligned with the axis Y. FIG. 9 shows the handle 2 in the folded position, where the top bar 34 is rotated to the vertical and the plane of the handle 2 is flat against the wall.

Figure 10:
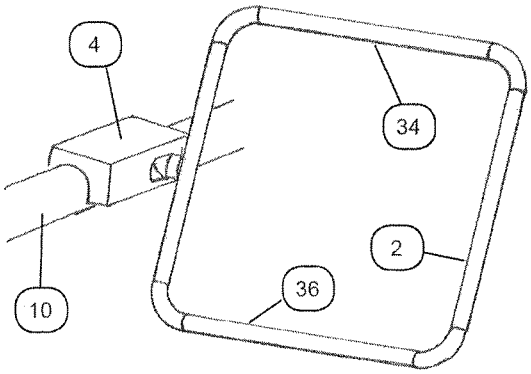
FIGS. 10 to 13 illustrate a second example of a folding mechanism in various views.
Figure 11:
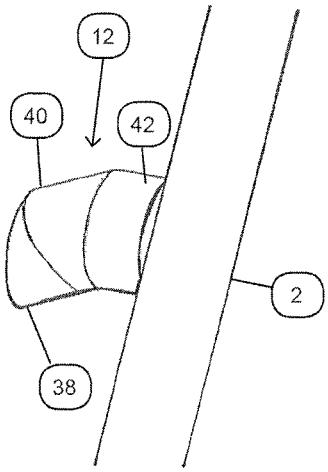
Figure 12:
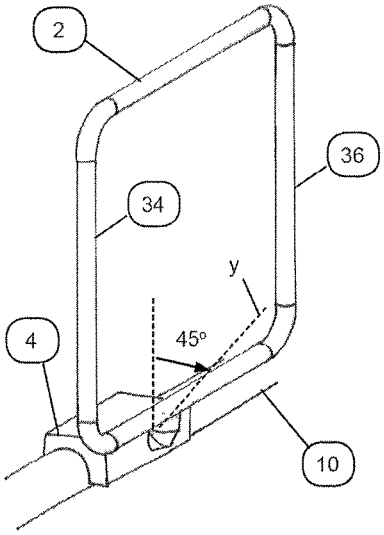
Figure 13:
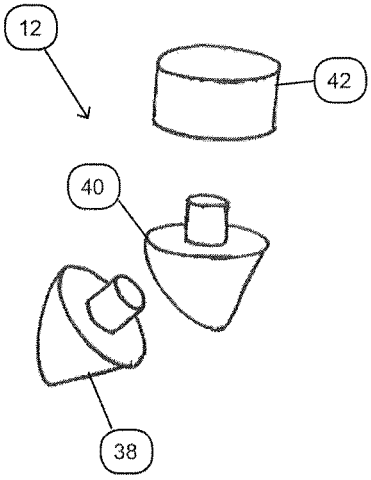

FIGS. 10 to 13 show a second example of a folding mechanism 12, with FIGS. 10 and 12 showing the handle 2 first in the normal walking position and then in the folded position, FIG. 11 showing a close up of the folding mechanism 12 and FIG. 13 showing components of the folding mechanism 12 in exploded view. In FIG. 10 the guide rail 10 is shown generally horizontal, which means that the handle 2 is not vertical.

In this example the handle 2 is connected to the saddle 4 by three rotating elements 38, 40, 42 that form two rotating joints. The first rotating joint is formed by two parts 38, 40 that each have two faces at 45 degrees to one another. A rotational joint along the 45 degree axis Y is hence formed at the joined 45 degree faces. The second rotating joint is formed by the joining of the second 45 degree wedge part 40 and a third part 42 that has two parallel faces. The handle 2 can be rotated about this joint in order to adjust it to follow the orientation of the stairs 14. This allows for different stair angles to be accommodated.

Figure 14:
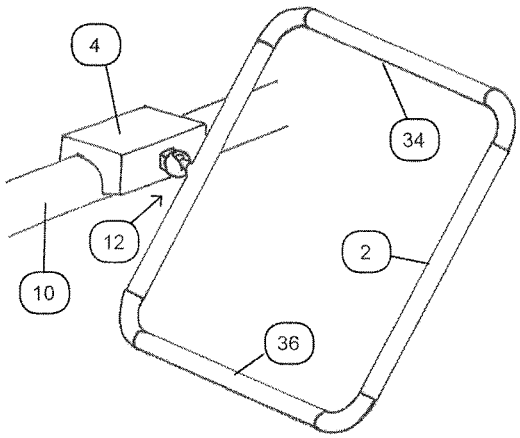
FIGS. 14 to 17 show a third example of a folding mechanism.
Figure 15:
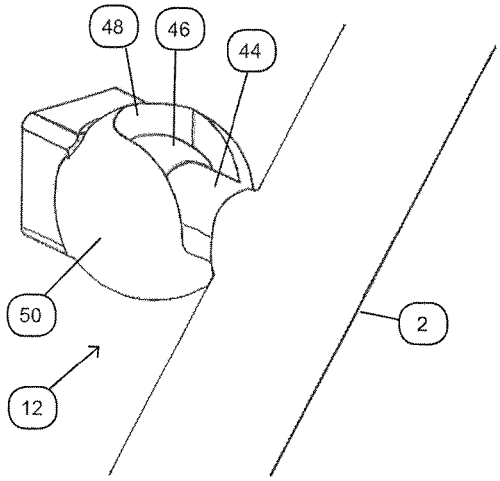
Figure 16:
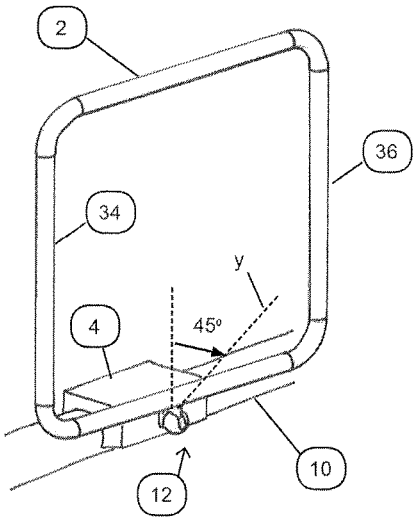
Figure 17:
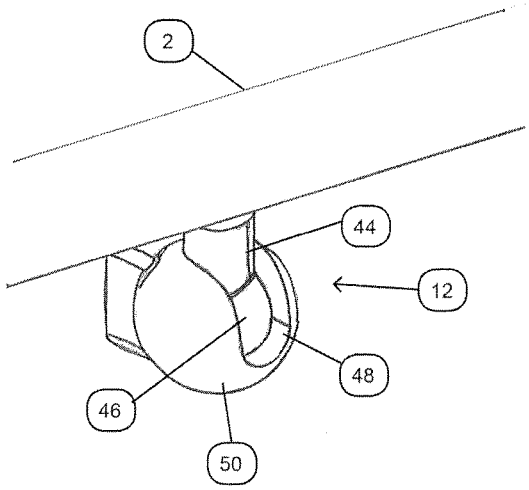

A third example of a folding mechanism is shown in FIGS. 14 to 17. FIGS. 14 and 16 show the handle 2 first in the normal walking position and then in the folded position, FIG. 15 shows a close up of the folding mechanism 12 in the normal walking position and FIG. 17 shows the folding mechanism 12 in the folded position. As with FIG. 10 the guide rail 10 in FIG. 14 is shown generally horizontal, which means that the handle 2 is not vertical. This example is implemented using a ball joint with the rod 44 connecting the ball 46 to the handle 2, and an opening 48 within the socket 50 guiding the motion of the rod 44 and restricting the rotation of the handle 2.

The rod 44 has a stadium shaped cross-section and the opening 48 guides the rod 44 from a folded position (FIGS. 16 and 17) where the rod 44 is at a first end of the opening 48, through a 90 degree arc about the axis of the guide rail 10 to a second end of the opening 48, where the handle 2 is in the walking position (FIGS. 14 and 15). At the second end of the arc the opening 48 is narrow so that the stadium cross-section of the rod 44 will only fit in when it is aligned with the opening 48. When at the second end of the opening 48 the rod 44 is hence held within the socket 50 without being able to rotate about the longitudinal axis of the rod 44. At the first end of the arc the opening 48 is wider and becomes large enough to accommodate the stadium cross-section of the rod 44 along its longest diameter. This means that the rod 44 can rotate about its longitudinal axis. The rotation of the handle 2 as the rod 44 passes along the arc of the opening 48 and rotates within the first end of the opening 48 provides the required rotating and folding motion to place the handle 2 against the wall. The combination of the two rotations gives rise to an effective rotation about the 45 degree axis Y.

A further feature of this folding mechanism is that the narrowing at the second end of the opening 48 is maintained in a zone of fixed width. This means that during the first part of movement along the arc away from the second end the handle 2 can be lifted but it cannot rotate about the longitudinal axis of the rod 44. This allows for the lifting motion A shown in FIG. 1 that disengages the pawl 20 from the holes 16, without giving rise to any instability of the handle 2.

Optionally the stair assistance device may include a mechanical lock (not shown) for enabling and disabling operation of the folding mechanism 12. For example, the device may include a handle or level that engages or retracts a small beam or pin into suitable holes or trenches in the folding mechanism 12. With the pin engaged then movement of parts of the folding mechanism relative to one another would be prevented. This would allow the folding mechanism 12 to be operated only when it is desired to fold the handle out of the way, to ensure that the folding mechanism 12 will not be triggered during use.

FIGS. 18 to 23 show another stair assist device. It will be appreciated that some features of this alternative device could be used with the device of FIG. 1, for example the folding mechanism of FIGS. 23(*a*) to (*d*), the wall-bracket shown in FIG. 22 or the locking device described with reference to FIGS. 20 and 21.

Figure 18:
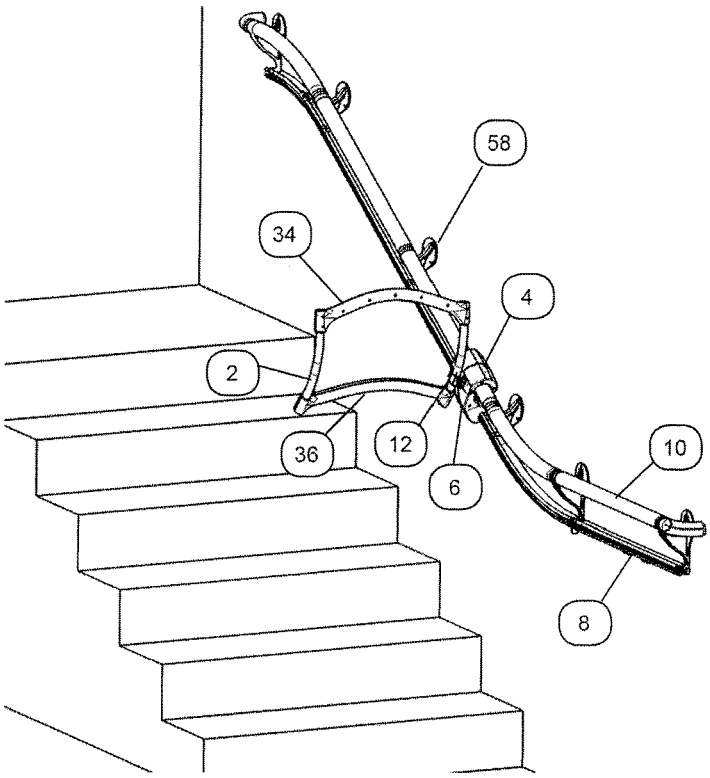
FIG. 18 shows another stair assistance device.
Figure 19:
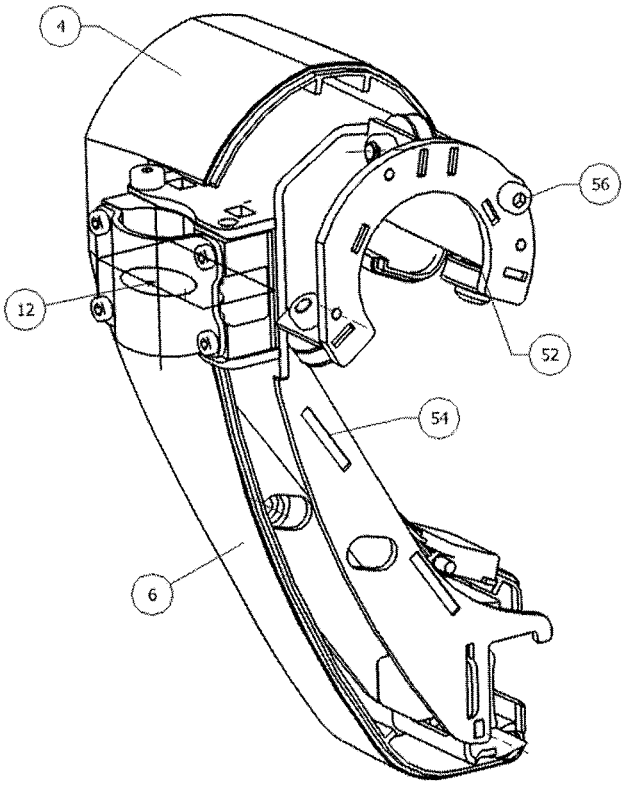
FIG. 19 shows the saddle and bracket of the stair assistance device of FIG. 18 in close-up view.

As with the stair assistance device of FIG. 1, the device of FIG. 18 has four main parts. There is a handle 2, saddle 4, bracket 6 and braking rail 8, which have the same main functions and the same basic layout as the equivalent parts of the device of FIG. 1. The stair assistance device is connected onto a guide rail 10 the bracket 6 joins to the braking rail 8 in a similar manner to the device of FIG. 1.

The basic operation of the device is similar to that of FIG. 1. Lifting the handle, via the upper bar 34 or the lower bar 36, disengages a pawl of the bracket 6 from a ratchet of the braking rail 8. This allows free movement of the device by sliding the saddle 4 up and down the guide rail 10. When the handle is not lifted then the device can slide upward, with the action of the ratchet preventing downward movement. Again, this is similar to the operation of the device of FIG. 1. There are however differences in the construction of the saddle 4 for the device of FIG. 18. It will also be noticed that this example uses wall brackets 58 that support both of the guide rail 10 and the braking rail 8.

The example of FIG. 18 has a saddle 4 and bracket 6 sections of differing shape and construction to that of FIG. 1. This is shown in greater detail in FIG. 19. The saddle 4 consists of two parts. A first plate 52 attaches the saddle 4 to the guide rail 10 and creates the sliding motion along the rail. A second plate 54 attaches the bracket 6 and the handle 2 to the first plate 54. The second plate 54 is connected with the first plate 52 by a shaft 56, which enables the second plate 54 to rotate whilst the first plate 52 remains generally fixed in place relative to the guide rail 10. The handle 2 and bracket 6 will therefore also be rotated around the shaft connection 56. If the handle 2 is moved and creates a rotation of the second plate 54 in the connection to the first plate 52, the bracket 6 will be moved away from or towards the braking rail 8.

Figure 20:
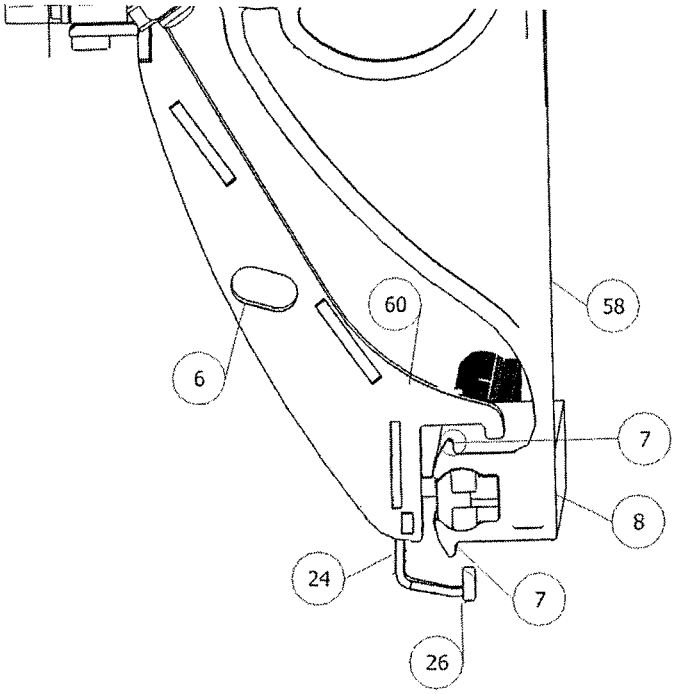
FIGS. 20 and 21 illustrate the bracket of FIG. 19 engaged with a guide rail with a locking device in first and second positions.
Figure 21:
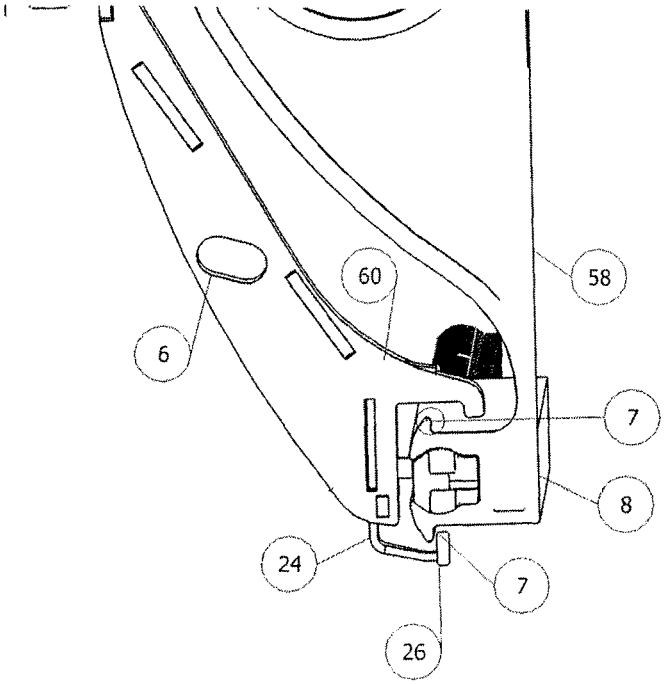

FIGS. 20 and 21 show further detail of the interaction of the bracket 6 with the braking rail 8 and this includes some details of the locking device 24. The braking rail 8 is an open sided box channel with a profile that holds the ratchet and receives the pawl mounted on the bracket 6. This channel could, for example, be an extruded part. Outer parts of the cross-section of the channel have protrusions 7 that fit with the ends of a C-section of the bracket 6. The teeth of the ratchet in the braking rail 8 are angled in the downstairs direction and the pawl in the bracket 6 is pointed in the same direction. The bracket 6 is coupled to the braking rail 8 with a C-section. A top part of the C-section is formed as a part of the bracket 6. A bottom part of the C-section is formed by a flap 26 of the locking device 24.

As with the example described above, the flap 26 of the locking device 24 has a first position where the ratchet will not engage with the pawl to prevent a motion of the handle (i.e. movement to lift the handle up) and a second position where the ratchet will prevent such a motion of the handle. The flap 26 is shown in the first position in FIG. 20. In this position the bracket 6 can be moved away from the braking rail 8 (i.e. to the left in the Figure) and this would disengage the pawl from the ratchet. The flap 26 can be moved up and down and if moved upward from the first position shown in FIG. 20 then it is in a second position, which is shown in FIG. 21. In this position the flap 26 keeps the bracket 6 in close contact with the braking rail 8 since it is engaged with a protrusion 7 on the channel of the braking rail 8.

The flap 26 is coupled to an actuator plate 60. This can be used to push or pull the flap 26 in to the first or the second position. The flap 26 could be moved by hand. In addition, the stair assist device can be provided with wedge shaped blocks on the wall near the guide rail 10 at the top and bottom of the travel of the saddle 4, which can act to push the flap 26 into the first or second position by contact with the actuator plate 60. Thus, the flap 26 can be automatically pushed into the second position when the device reaches the bottom of the stairway, and, optionally, automatically pushed into the first position when the device reaches the top of the stairway. This means that the stair assistance device is automatically set up for the next user.

Figure 22:
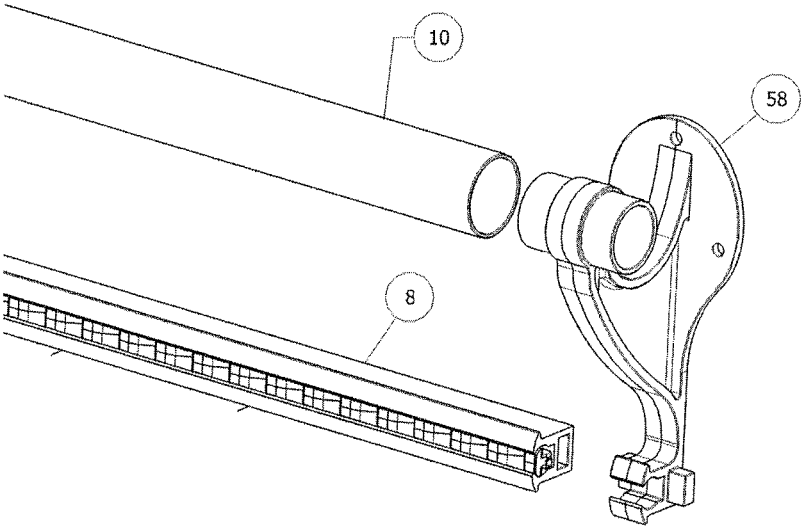
FIG. 22 shows an example wall-bracket for holding a guide rail and braking rail.

The ratchet and pawl mechanism might, for example, be similar to that shown in FIGS. 3, 4 and 5. Alternatively, the ratchet might be of a toothed design as illustrated in FIG. 22, with the pawl being designed appropriately to engage with the ratchet. FIG. 22 also shows a further feature of the example of FIG. 18, which is the use of a wall bracket 58 that supports both of the guide rail 10 and the braking rail 8. As can be seen in FIG. 22, the guide rail 10 and braking rail 8 are split into segments, which are joined at the wall bracket 58. In FIG. 22 segments of the rails, 10 are shown in exploded on the left of the bracket 58. Additional segments can be fitted on the right of the bracket 58 to form a whole rail as shown in FIG. 18. Also shown in FIG. 22 is a segment of the ratchet. With the C-channel design of the braking rail 8 the ratchet can be formed in separate segments and inserted during assembly of the device.

Figure 23:
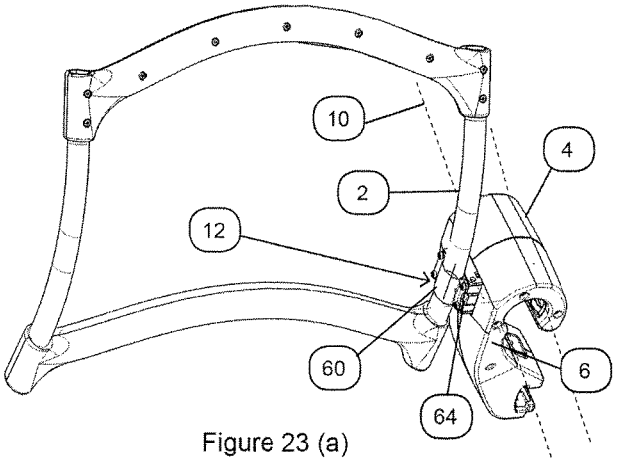
FIGS. 23 (*a*) to (*d*) show an alternative folding mechanism.
Figure 23:
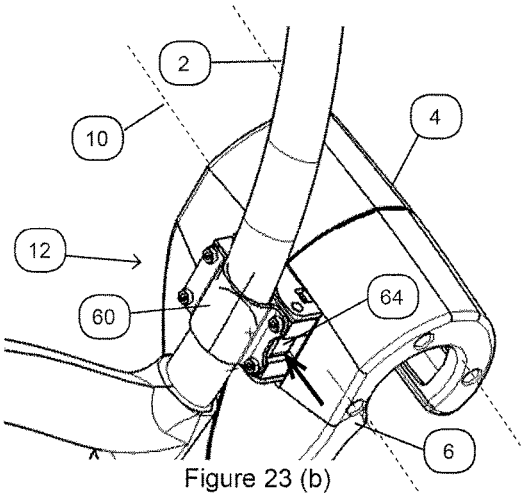
Figure 23:
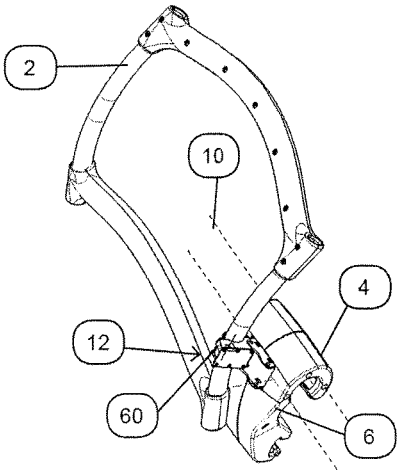
Figure 23:
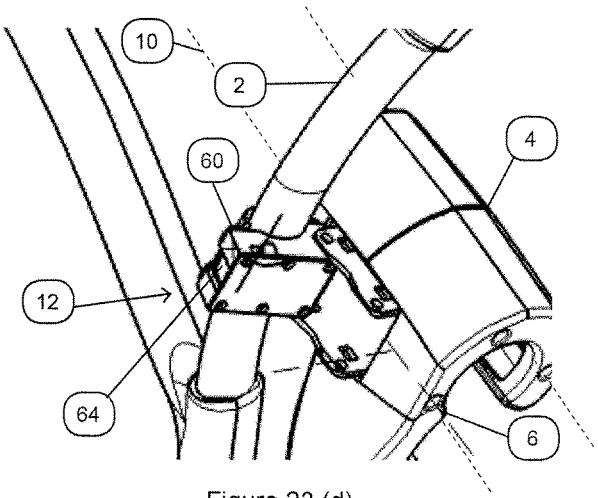

Another difference between the device of FIGS. 18-23 and the device shown in FIG. 1 is the design of the folding mechanism 12. FIGS. 23(*a*) to 23(*d*) show the folding mechanism 12 in various positions. In FIGS. 23(*a*) and 23(*b*) a part of the handle 2 is shown. With this example the folding mechanism uses a hinged joint 60 coupled to the part of the handle 2 where the handle is attached to the saddle 4 and bracket 6. This is part of the handle 2 remains perpendicular to the rails 8, 10 at all times. The folding of the handle is a simple rotation about the hinge 60 at the point it is attached to the saddle. This turns the handle 2 90 degrees towards the rails 8, 10 and leaves the handle flat against the wall. This folding occurs in the upward direction in this example.

A spring lock is used to keep the handle in the outward position, and this needs to be released to be able to fold the handle. The spring lock is a flexible resilient block with a shape as shown in FIG. 23(*d*). The spring lock is released by pushing a button 64. When the button 64 is pushed the lock releases the handle 2 for movement with the hinge 60 and the handle can be rotated 90 degrees. The spring lock is engaged to lock the handle in place by a pair of locking lugs 64. These are disengaged when the button 64 is pushed, and when the button 64 is released then they spring back into place due to the resilience of the spring lock. The lugs have angled tops so that the spring lock is self-locking. When the handle 2 swings back to the unfolded position then the locking lugs are pushed inward by a forced on the angled tops and then click back into place to secure the handle.

We claim:

1. A stair assistance device for assisting a person to climb up and down stairs, the device comprising:

a handle;

a saddle for engagement with a guide rail mounted alongside the stairs, the saddle being connected to the handle and being arranged for sliding motion along the guide rail;

a braking rail for mounting alongside the stairs parallel to the guide rail; and a bracket connected to the saddle, the bracket for selectively engaging with the braking rail to prevent motion of the handle and saddle along the guide rail;

wherein the bracket and the braking rail together form a releasable ratchet that, when engaged, prevents movement of the handle in a downstairs direction and allows movement of the handle in an upstairs direction; and wherein the handle is coupled to the pawl of the ratchet such that a predetermined movement of the handle relative to the braking rail will disengage a pawl from the ratchet so that the handle may move freely in both the upstairs and the downstairs direction;

the stair assistance device further comprising a locking device for selectively preventing disengagement of the ratchet;

wherein the locking device has a first position where the ratchet can be disengaged by the predetermined movement of the handle and a second position where the ratchet cannot be disengaged; and wherein the locking device comprises an adjustable flap connected to the bracket, wherein in the first position the flap allows a sufficient range of movement of the bracket relative to the braking rail in order to permit the pawl to disengage from the rack, and in the second position the movement of the bracket is restricted so that the pawl always remains engaged.

2. The stair assistance device as claimed in claim 1, wherein the predetermined movement is a lifting of the handle to rotate the handle about a long axis of the guide rail and move the bracket and pawl sideways away from the braking rail to thereby disengage the pawl.

3. The stair assistance device as claimed in claim 1 wherein the pawl is a rotating finger arranged to engage with a linear rack extending along a length of the braking rail, and wherein the rack has teeth that are angled in a direction down the stairs.

4. The stair assistance device as claimed in claim 3, wherein the braking rail comprises a strip of generally rigid material with holes spaced along the strip, and wherein the lands between the holes form the teeth of the rack.

5. The stair assistance device as claimed in claim 1, wherein the adjustable flap is moveable in a sliding fashion relative to the bracket in order to increase and decrease a distance by which the bracket can move relative to the braking rail.

6. The stair assistance device as claimed in claim 1, wherein the locking device comprises a secondary locking mechanism arranged to releasably secure the flap in its second position.

7. The stair assistance device as claimed in claim 1, comprising a folding mechanism that enables the handle to be folded away.

8. The stair assistance device as claimed in claim 7, wherein the handle includes top and bottom gripping portions, such that there is a plane of the handle that extends between the top and bottom gripping portions and in a vertical direction in normal use; and wherein the folding mechanism is arranged to permit rotation of the handle about an axis that is at about 45 degrees to the vertical and extends away from the guide rail across the plane of the handle.

9. The stair assistance device as claimed in claim 8, wherein the folding mechanism comprises a single rotating joint that couples the handle to the saddle, with the rotating joint being mounted to the saddle to provide a rotation about the axis that is at about 45 degrees to the vertical and extends away from the guide rail across the plane of the handle.

10. The stair assistance device as claimed in claim 8, wherein the folding mechanism is arranged to permit rotation about more than one axis, wherein the rotations about the multiple axes combine to create a total rotation that is about the axis that is at about 45 degrees to the vertical and extends away from the guide rail across the plane of the handle.

11. The stair assistance device as claimed in claim 10, wherein the folding mechanism comprises multiple cylindrical joints connected to one another to produce the required combined motion.

12. The stair assistance device as claimed in claim 10, wherein the folding mechanism is a ball joint with a restricted degree of freedom, wherein the socket of the ball joint has an opening that constrains movement of the rod connected to the ball.

13. The stair assistance device as claimed in claim 12, wherein the opening permits the rod to rotate perpendicular to its longitudinal axis along a 90 degree arc and to rotate about its longitudinal axis only at a first end of this arc, with rotation about its longitudinal axis being prevented at the second end of the arc.

14. The stair assistance device as claimed in claim 13, wherein the rod has a stadium shaped cross-section, and the opening narrows to the width of the stadium at the second end, but is wide enough to permit rotation of the stadium at the first end.

* * * * *